US007461639B2

(12) United States Patent
Jehlik

(10) Patent No.: US 7,461,639 B2
(45) Date of Patent: Dec. 9, 2008

(54) COATED HEAT EXCHANGER

(75) Inventor: Forrest A. Jehlik, Chicago, IL (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/706,137

(22) Filed: Feb. 13, 2007

(65) Prior Publication Data

US 2007/0246203 A1 Oct. 25, 2007

Related U.S. Application Data

(60) Provisional application No. 60/794,796, filed on Apr. 25, 2006.

(51) Int. Cl.
*F28D 7/16* (2006.01)
*F02M 25/07* (2006.01)

(52) U.S. Cl. ..... 123/568.12; 165/159

(58) Field of Classification Search ..... 123/568.12; 165/159

See application file for complete search history.

(56) References Cited

U.S. PATENT DOCUMENTS 3,273,550 A * 9/1966 Ball ..... 123/572
3,602,979 A 9/1971 La Iacona
3,632,459 A 1/1972 Klauer
4,106,449 A * 8/1978 Matsumoto et al. .... 123/568.12
4,749,031 A * 6/1988 Fukumoto ..... 165/159
5,607,010 A * 3/1997 Schonfeld et al. ..... 165/51
6,595,274 B2 7/2003 Hayashi et al.
6,684,938 B2 * 2/2004 Tsujita et al. ..... 165/51
6,976,481 B2 * 12/2005 Kobayashi et al. ..... 123/568.12
7,121,325 B2 * 10/2006 Kruger et al. ..... 165/51
7,171,956 B2 * 2/2007 Igami et al. ..... 123/568.12
2003/0121649 A1 7/2003 Seiler et al.
2006/0090880 A1 * 5/2006 Sugihara et al. ..... 165/103

* cited by examiner

*Primary Examiner*—Stephen K. Cronin
*Assistant Examiner*—Arnold Castro

(57) ABSTRACT

A heat exchanger includes a housing with an exhaust inlet, an exhaust outlet, a fluid inlet, and a fluid outlet. A plurality of heat exchange conduits has a first surface in fluid communication with the exhaust inlet and the exhaust outlet and has a second surface in fluid communication with the fluid inlet and the fluid outlet, wherein the first surface is coated with a material including Teflon®.

2 Claims, 3 Drawing Sheets

COATED HEAT EXCHANGER

CROSS-REFERENCE TO RELATED APPLICATIONS

This application claims the benefit of U.S. Provisional Application No. 60/794,796, filed on Apr. 25, 2006. The disclosure of the above application is incorporated herein by reference.

FIELD OF THE INVENTION

The present invention relates to heat exchangers, and more particularly to heat exchangers for an exhaust gas recirculation system of a vehicle.

BACKGROUND OF THE INVENTION

Vehicle engines produce oxides of nitrogen (NOx) as a component of vehicle emissions. In an effort to reduce NOx levels in vehicle emissions, manufacturers typically employ an exhaust gas recirculation (EGR) system. The EGR system reduces NOx levels by recirculating exhaust gas into the intake manifold where the exhaust gas mixes with incoming air and fuel. NOx forms in high concentrations when combustion temperatures exceed a predetermined temperature. By diluting the air/fuel ratio, peak combustion temperatures are reduced.

Combustion temperatures can be further reduced by cooling the re-circulated exhaust gas. Therefore, some EGR systems include a heat exchanger that cools the exhaust gas before injection into the intake manifold. A valve or other metering device may be used to regulate the flow of exhaust into the intake manifold.

In the heat exchanger, the exhaust travels through a plurality of heat exchange conduits that are made from a thermally conductive material. One surface of the heat exchange conduits is in contact with the exhaust gas and another surface is in contact with a fluid (coolant or air) that absorbs heat from the exhaust gas. The heat transfer efficiency may be reduced due to fouling or coagulation of exhaust particles in the heat exchange conduits. As a result, the heat exchanger is usually oversized to compensate for fouling. This compromises packaging space, heat exchanger design, and/or vehicle weight.

SUMMARY OF THE INVENTION

Accordingly, a heat exchanger includes a housing with an exhaust inlet, an exhaust outlet, a fluid inlet, and a fluid outlet. A plurality of heat exchange conduits has a first surface in fluid communication with the exhaust inlet and the exhaust outlet and has a second surface in fluid communication with the fluid inlet and the fluid outlet, wherein the first surface is coated with a material including polytetrafluoroethylene, known by the trademark Teflon®. The trademark Teflon® will be used in the description.

In one feature, the housing includes an inlet plate and an outlet plate where first ends of the plurality of heat exchange conduits mate with the inlet plate and second ends of the plurality of heat exchange conduits mate with the outlet plate.

In another feature, heat exchange conduits include a plurality of elongate tubes that extend between the inlet plate and the outlet plate.

In still another feature, the material including Teflon® further includes bronze.

In yet another feature, an exhaust gas recirculation system includes the heat exchanger and an exhaust gas recirculation valve that directs exhaust gas from an exhaust to an engine.

In an alternate embodiment, a heat exchanger includes a housing including an exhaust inlet, an exhaust outlet, a fluid inlet, and a fluid outlet. An exhaust conduit in fluid communication with the exhaust outlet and the exhaust inlet, comprises an area between facing surfaces of a first plate and a second plate and the facing surfaces are coated with a material including Teflon®. A fluid conduit in fluid communication with the fluid inlet and the fluid outlet, comprises an area between facing surfaces of the second plate and a third plate, and the second plate transfers heat from exhaust gas flowing through the exhaust conduit to fluid flowing through the fluid conduit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. As used herein, the term module refers to an application specific integrated circuit (ASIC), an electronic circuit, a processor (shared, dedicated, or group), and memory that executes one or more software or firmware programs, a combinational logic circuit, and/or other suitable components that provide the described functionality.

According to the present invention, surfaces of heat exchange conduits in a heat exchanger are coated with a material including Teflon® to reduce fouling.

Figure 1:
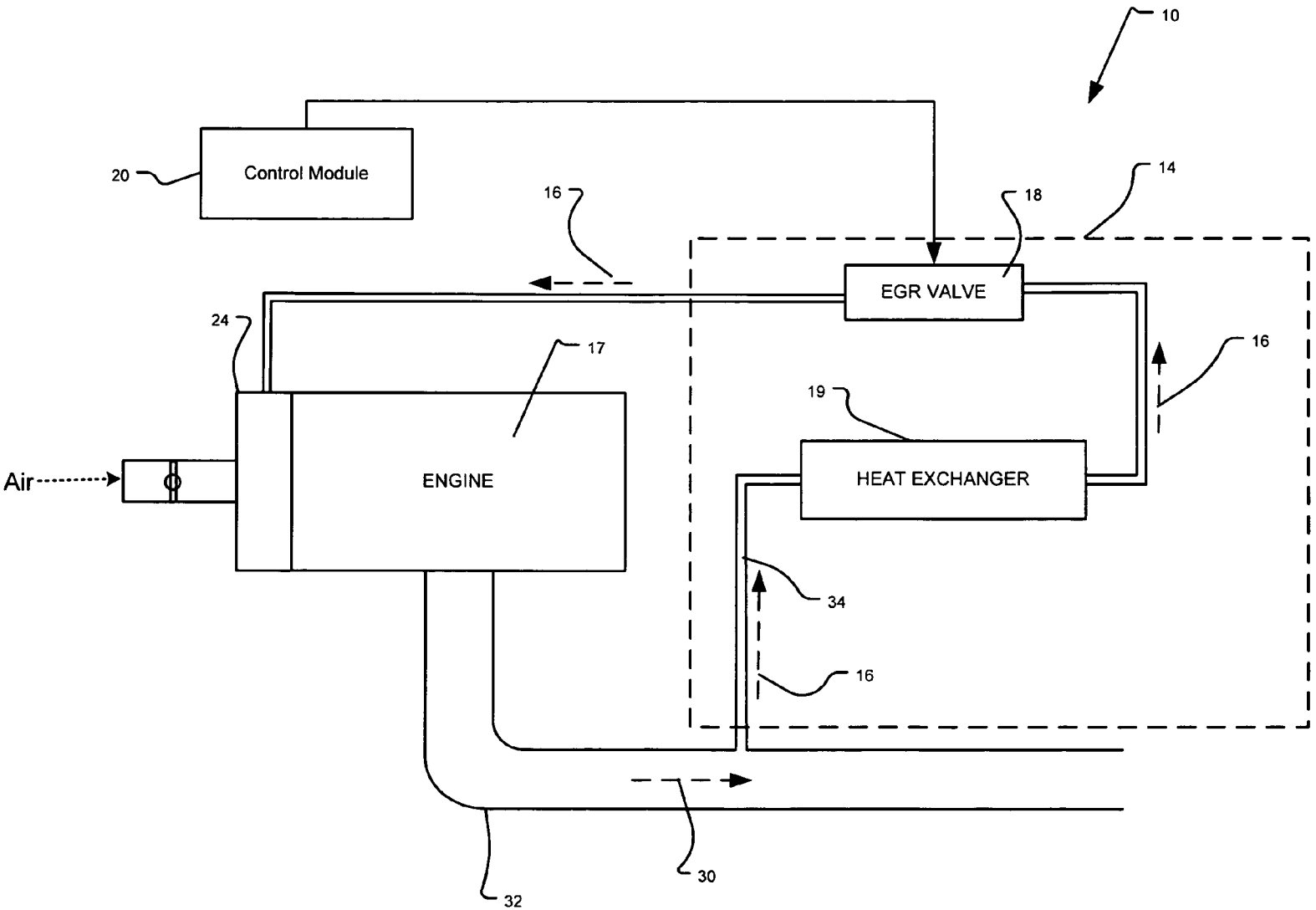
FIG. 1 is a functional block diagram illustrating a vehicle with an exhaust gas recirculation system according to the present invention.

Referring now to FIG. 1, a vehicle 10 includes an exhaust gas recirculation (EGR) system 14 that selectively supplies re-circulated exhaust gas 16 to an engine 17. The EGR system 14 includes the EGR valve 18 and a heat exchanger 19. A control module 20 selectively opens and closes the EGR valve 18 during engine operation to allow the re-circulated exhaust gas 16 into an intake manifold 24. The EGR valve 18 may be positioned between partially open and partially closed positions. Exhaust gas 30 from the engine 17 flows into an exhaust manifold 32. A recirculation exhaust conduit 34 directs some of the exhaust gas 30 into the EGR system 14. The heat exchanger 19 cools the re-circulated exhaust gas 16.

Skilled artisans will appreciate that the present invention applies to various heat exchanger configurations. For example, the heat exchanger may have a tube-type, plate-type, shell-type, or any other suitable design.

Figure 2B:
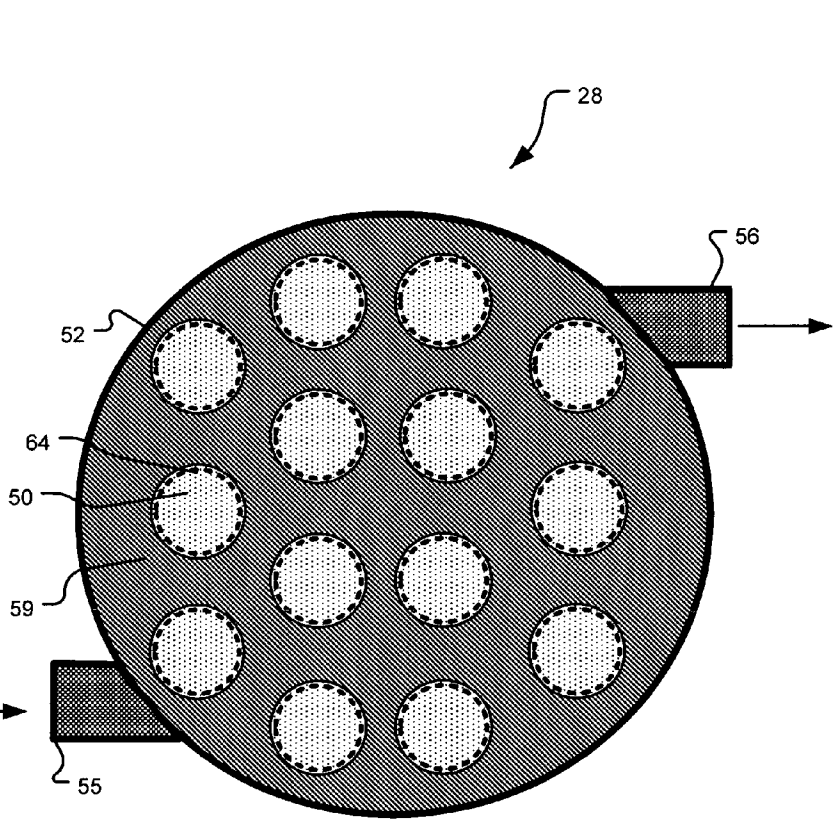
FIG. 2B is a cross-sectional end view of a tube-type heat exchanger according to the present invention.
Figure 2A:
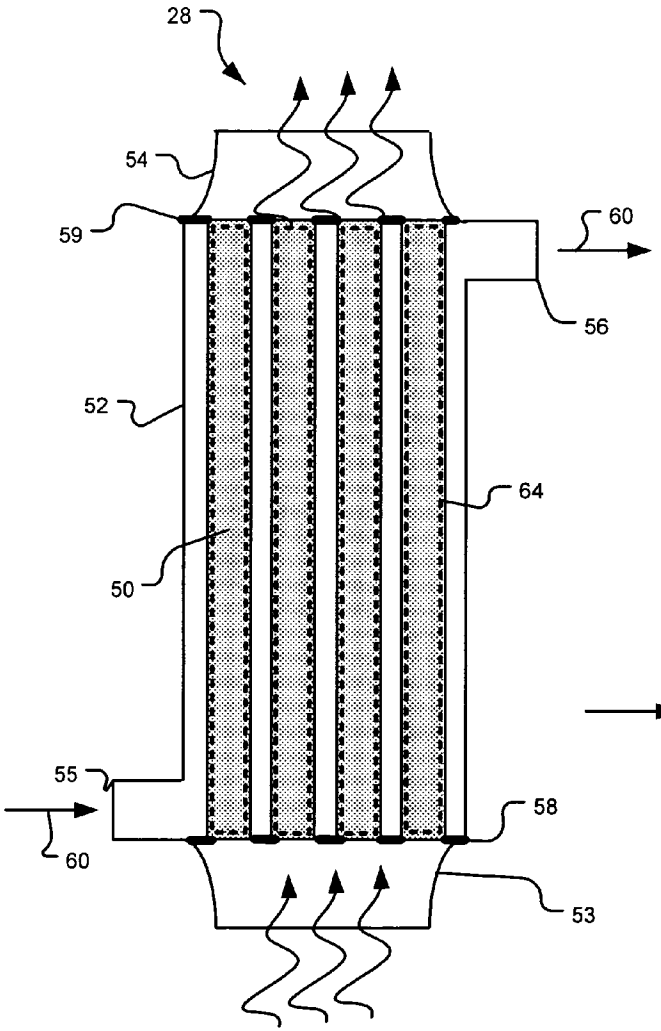
FIG. 2A is a cross-sectional side view of a tube-type heat exchanger according to the present invention.

Referring now to FIGS. 2A and 2B, an exemplary embodiment of a tube-type heat exchanger 28 includes a plurality of tubes 50 that are located in a housing 52. An exhaust inlet opening 53 and an exhaust outlet opening 54 are located at opposite ends of the heat exchanger 28. The housing 52 also includes a fluid inlet opening 55 and a fluid outlet opening 56. An inlet plate 58 and outlet plate 59 may be positioned between the exhaust inlet opening 53 and housing 52 and between the housing 52 and the exhaust outlet opening 54, respectively.

The re-circulated exhaust gas 16 enters the heat exchanger 28 through the exhaust inlet opening 53, flows through the plurality of tubes 50, and exits through the exhaust outlet opening 54. The re-circulated exhaust gas 16 is cooled as it flows through the plurality of tubes 50. For example, a fluid 60 such as coolant or air surrounds the tubes 50. Since the tubes 50 are made from a highly conductive material, the fluid 60 surrounding the tubes 50 absorbs heat as the re-circulated exhaust gas 16 flows through the tubes 50.

The fluid inlet opening 55 and fluid outlet opening 56 define a pathway through the cylindrical housing 52 for the fluid 60. More specifically, the fluid 60 enters the fluid inlet opening 55, flows between the tubes 50, and exits through the fluid outlet opening 56. The inlet and outlet plates 58,59 contain the fluid 60 within the housing 52.

A material 64 that includes Teflon® is applied to the inner surfaces of the tubes 50. The material 64 may include a thermally conductive material since Teflon® impedes heat transfer. The thermally conductive material may include bronze. The material 64, when applied to the heat exchange conduits in the heat exchanger 28, reduces fouling.

Figure 3A:
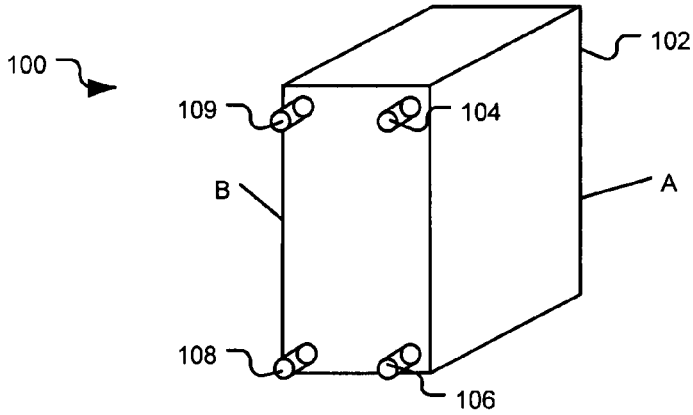
FIG. 3A illustrates plate-type heat exchanger according to an alternate embodiment.

Referring now to FIG. 3A, an alternate embodiment of the present invention is a plate-type heat exchanger 100. The plate-type heat exchanger 100 includes a plurality of plates, shown in conjunction with FIGS. 3B and 3C, within a housing 102. An exhaust inlet 104, an exhaust outlet 106, a fluid inlet 108, and a fluid outlet 109 are in fluid communication with the plates within the housing 102.

Figure 3B:
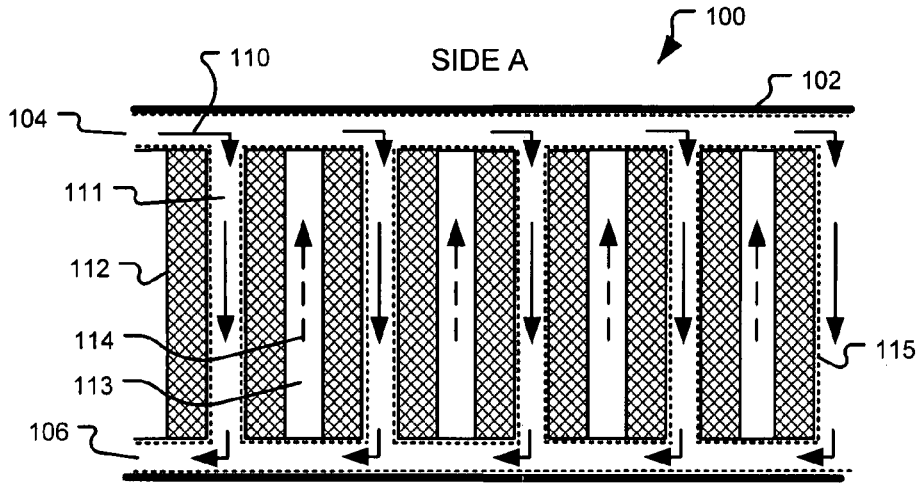
FIG. 3B is a cross-sectional side view of a plate-type heat exchanger according to an alternate embodiment.

Referring now to FIG. 3B, a cross-sectional side view of the plate-type heat exchanger 100 illustrates the flow of exhaust gas 1 10 through the plate-type heat exchanger 100. According to an exemplary embodiment of the present invention, exhaust gas 110 enters the plate-type heat exchanger 100 through the exhaust inlet 104, flows through a plurality of exhaust conduits 111, and out of the exhaust outlet 106. The plates 112 are placed in a parallel arrangement with respect to each other within the housing 102. The plates 112 are separated from each other to create exhaust conduits 111 and fluid conduits 113 for the exhaust gas 110 and fluid 114 to flow through, respectively. The plates 112 will have one side in fluid communication with the exhaust gas 110 and the opposite side in fluid communication with the fluid 114. A Teflon®-based material 115 is used to coat the exhaust conduits 111, the exhaust inlet 104, and the exhaust outlet 106 to reduce fouling.

Figure 3C:
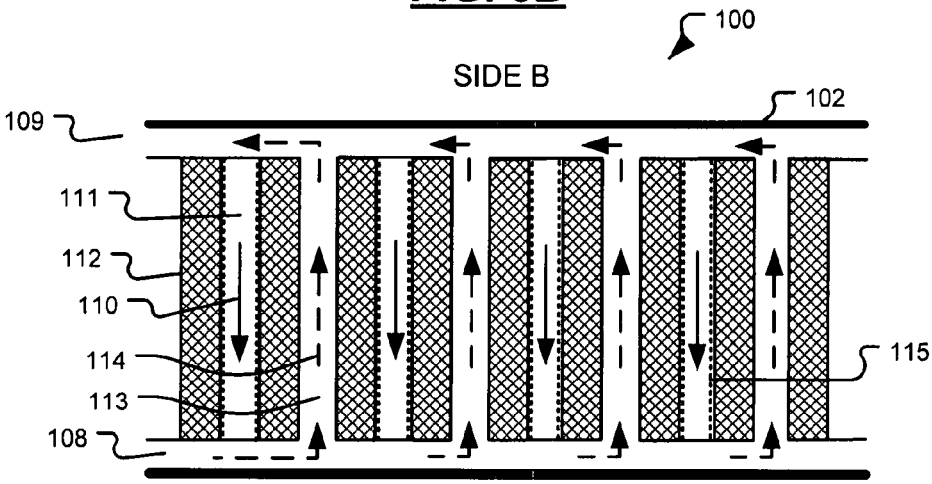
FIG. 3C is a cross-sectional side view of a plate-type heat exchanger according to the alternate embodiment.

Referring now to FIG. 3C, a cross-sectional side view of the plate-type heat exchanger 100 illustrates the flow of fluid 114 through the plate-type heat exchanger 100. According to an exemplary embodiment of the present invention, fluid 114 enters through the fluid inlet 108, flows through a plurality of fluid conduits 113 located between the plates 112, and out of the fluid outlet 109. The plates 112 transfer heat from the exhaust gas 110 to the fluid 114. In some implementations, the exhaust gas 110 and fluid 114 may flow in the same direction (not shown) and/or the plates 112 may have depressions (not shown) to create a more efficient heat transfer.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A heat exchanger comprising:

a housing including an exhaust inlet, an exhaust outlet, a fluid inlet, and a fluid outlet; and a plurality of heat exchange conduits having a first surface in fluid communication with said exhaust inlet and said exhaust outlet and having a second surface in fluid communication with said fluid inlet and said fluid outlet, wherein said first surface is coated with a material including polytetrafluoroethylene (PTFE), wherein said material including PTFE further includes bronze.

2. A heat exchanger comprising:

a housing including an exhaust inlet, an exhaust outlet, a fluid inlet, and a fluid outlet;

an exhaust conduit in fluid communication with said exhaust outlet and said exhaust inlet, comprising an area between facing surfaces of a first plate and a second plate wherein said facing surfaces are coated with a material including polytetrafluoroethylene (PTFE);

a fluid conduit in fluid communication with said fluid inlet and said fluid outlet comprising an area between facing surfaces of said second plate and a third plate, wherein said second plate transfers heat from exhaust gas flowing through said exhaust conduit to fluid flowing through said fluid conduit; and wherein said material including PTFE further includes bronze.

* * * * *